US012590523B2

(12) United States Patent
Hollier et al.

(10) Patent No.: US 12,590,523 B2
(45) Date of Patent: Mar. 31, 2026

(54) HANDS FREE FRAC LINE CONNECTION METHOD AND SYSTEM

(71) Applicant: Oil States Energy Services, L.L.C., Houston, TX (US)

(72) Inventors: Tyler Hollier, Carencro, LA (US); Jimmy Livingston, Manvel, TX (US); Dennis Clemmons, Youngsville, LA (US)

(73) Assignee: Oil States Energy Services, L.L.C., Houston, TX (US)

( * ) Notice: Subject to any disclaimer, the term of this patent is extended or adjusted under 35 U.S.C. 154(b) by 0 days.

(21) Appl. No.: 18/609,661

(22) Filed: Mar. 19, 2024

(65) Prior Publication Data

US 2025/0297541 A1 Sep. 25, 2025

(51) Int. Cl.
*E21B 43/26* (2006.01)
*E21B 17/04* (2006.01)

(52) U.S. Cl.
CPC ..... *E21B 43/2607* (2020.05); *E21B 17/04* (2013.01); *E21B 43/26* (2013.01)

(58) Field of Classification Search
CPC ..... E21B 43/2607; E21B 17/04; E21B 43/26
See application file for complete search history.

(56) References Cited

U.S. PATENT DOCUMENTS 4,850,750 A * 7/1989 Cogbill ..... E21B 43/26 414/300
2012/0227814 A1* 9/2012 Kendrick ..... F16L 27/0804 137/1
2017/0298700 A1* 10/2017 Robichaux ..... E21B 19/008
2019/0302810 A1* 10/2019 Kibler ..... G05D 3/125
2021/0372548 A1* 12/2021 Post ..... E21B 43/2607
2022/0090474 A1* 3/2022 Clark ..... E21B 43/26

* cited by examiner

*Primary Examiner* — James G Sayre
(74) *Attorney, Agent, or Firm* — Morgan, Lewis & Bockius LLP

(57) ABSTRACT

A method for establishing a remote connection between a hydraulic fracturing head and hydraulic fracturing tubing line that is not reliant on personnel to manually establish a connection between the hydraulic fracturing tubing line and hydraulic fracturing head. The hydraulic fracturing tubing head is elevated above and connected to a wellbore. Next, a hydraulic fracturing tubing line is elevated to the hydraulic fracturing tubing head by connecting lines which are guided by a set of dual roller assemblies. The hydraulic fracturing tubing line is equipped with a male connector, configured to fit within a latching receptacle, which is installed on the hydraulic fracturing head. Once the male connector is seated in the latching receptacle, hydraulic pressure release closes latches on the latching receptacle, establishing a fluid connection. Once connected, hydraulic fracturing can begin.

10 Claims, 5 Drawing Sheets

HANDS FREE FRAC LINE CONNECTION METHOD AND SYSTEM

TECHNICAL FIELD

The present disclosure relates generally to establishing a remote connection of a hydraulic fracturing tubing line and a hydraulic fracturing tubing head, and more particularly, to eliminate the need for personnel intervention when establishing the connection.

Within the embodiments described, there are multiple types of arrangements that provide the remote connection method disclosed herein and should not be read out of the disclosure because one such example is given.

BACKGROUND OF THE INVENTION

It is almost ubiquitous now in oil and gas operations to include hydraulic fracturing as part of an overall plan. In some applications, operators may be exposed to certain dangerous conditions during hydraulic fracturing operations. Hydraulic fracturing operations require extremely high pressures. In addition, many oil and gas operations are conducted offshore. In some applications, personnel may be exposed to dangerous conditions during offshore operations, especially when personnel must work at an elevated height.

To conduct a hydraulic fracturing operation, a fluid source must be connected to the wellbore in order to pump hydraulic fracturing fluid into the wellbore. Due to the nature of offshore drilling, these sources and connections are elevated. When making a connection of a hydraulic fracturing fluid source to a wellbore, conventionally, this requires personnel making a manual connection.

Conventionally, joining a wellhead and hydraulic fracturing fluid source requires elevating a hydraulic fracturing head above the wellbore and connecting the two. Then, the hydraulic fracturing tubing is hoisted in the air with an air tugger. Next, personnel must be lifted alongside to create a hammer union between the hydraulic fracturing head and the hydraulic fracturing tubing.

This method has several drawbacks. In particular, and most importantly, this requires personnel to be in direct contact with the hydraulic fracturing equipment. Certain conventional methods can create dangerous conditions due to working at an elevated height and from the high pressures used in hydraulic fracturing operations. In addition, should issues arise with the connection after the initial hammer union is made, personnel may have to be hoisted back up in direct contact with the equipment, thereby increasing their exposure to dangerous conditions.

Another drawback of certain conventional methods is the use of hoisting equipment. Commonly, this requires an air tugger to lift the hydraulic fracturing tubing to the hydraulic fracturing head. However, this takes away an air tugger that could be used in other rig operations. In addition, air tuggers may not be placed conveniently for use in such an operation, due to the orientation of the hydraulic fracturing head assembly.

The present invention addresses the need to reduce direct personnel contact with potentially dangerous conditions and reduce the complexity of the equipment used.

SUMMARY OF THE INVENTION

Aspects of the current invention provide a method for remotely engaging a fluid connection between a hydraulic fracturing head and a hydraulic fracturing tubing line without the need for manual personnel intervention.

In an exemplary embodiment, the hydraulic fracturing head is elevated above and secured to a wellbore via a Christmas tree. The hydraulic fracturing head includes a side entry sub and adapter block with the receptacle to be connected on. The hydraulic fracturing head also includes, on the adapter block, two dual roller assemblies, each with two sets of two rollers, perpendicularly situated within the dual roller assembly to assist in guiding a connecting line. This connecting line is attached to a hydraulic fracturing tubing line via a saddle assembly. The saddle assembly holds a receptacle to be joined on the hydraulic fracturing head.

In an exemplary embodiment, the receptacle attached to the hydraulic fracturing head is a latching receptacle. This latching receptacle has a funnel shape and is configured to accept a male connector. This latching receptacle contains latches that may be opened through a hydraulic line connected to the latching receptacle, facilitating a remote connection. The hydraulic fracturing tubing line contains a male connector. This male connector is a male connection that is tapered in shape, configured to connect within the latching receptacle.

In operation, the hydraulic fracturing tubing line is elevated relative to the hydraulic fracturing head, being drawn by the connecting lines. The connecting lines travel over and through the dual roller assemblies, which guide the hydraulic fracturing tubing line to the hydraulic fracturing head.

In an exemplary embodiment, the male connector stabs into the latching receptacle, which is opened by engaging hydraulic pressure to open latches. Once the male connector is seated inside the latching receptacle, the hydraulic pressure is released, closing the latches and establishing the connection. Notably, this union between the hydraulic fracturing head and hydraulic fracturing tubing line is achieved without the need for personnel to mechanically establish the connection.

Once connection is achieved, fluid connectivity is established between the hydraulic fracturing tubing line and the hydraulic fracturing head. This facilitates the ability to perform hydraulic fracturing by causing fluid to be sent from a fluid source, to the hydraulic fracturing tubing line, to the hydraulic fracturing head, and, finally, to the wellbore.

In another embodiment, the male connector may be attached to the hydraulic fracturing head and the latching receptacle may be attached to the hydraulic fracturing tubing line. In this embodiment, a connection between the hydraulic fracturing head and the hydraulic fracturing tubing line is still achieved remotely. In operation, the hydraulic fracturing tubing line is guided over the hydraulic fracturing head. With the disclosed components, the connection is achieved hydraulically.

In addition to the alternative configuration above, the dual roller assemblies can be replaced with a dual winch system. Using a dual winch system can take the guiding place of a dual roller assembly while still guiding and elevating the hydraulic fracturing tubing line to the hydraulic fracturing head, achieving a remote connection.

BRIEF DESCRIPTION OF DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION OF THE INVENTION

Figure 1:
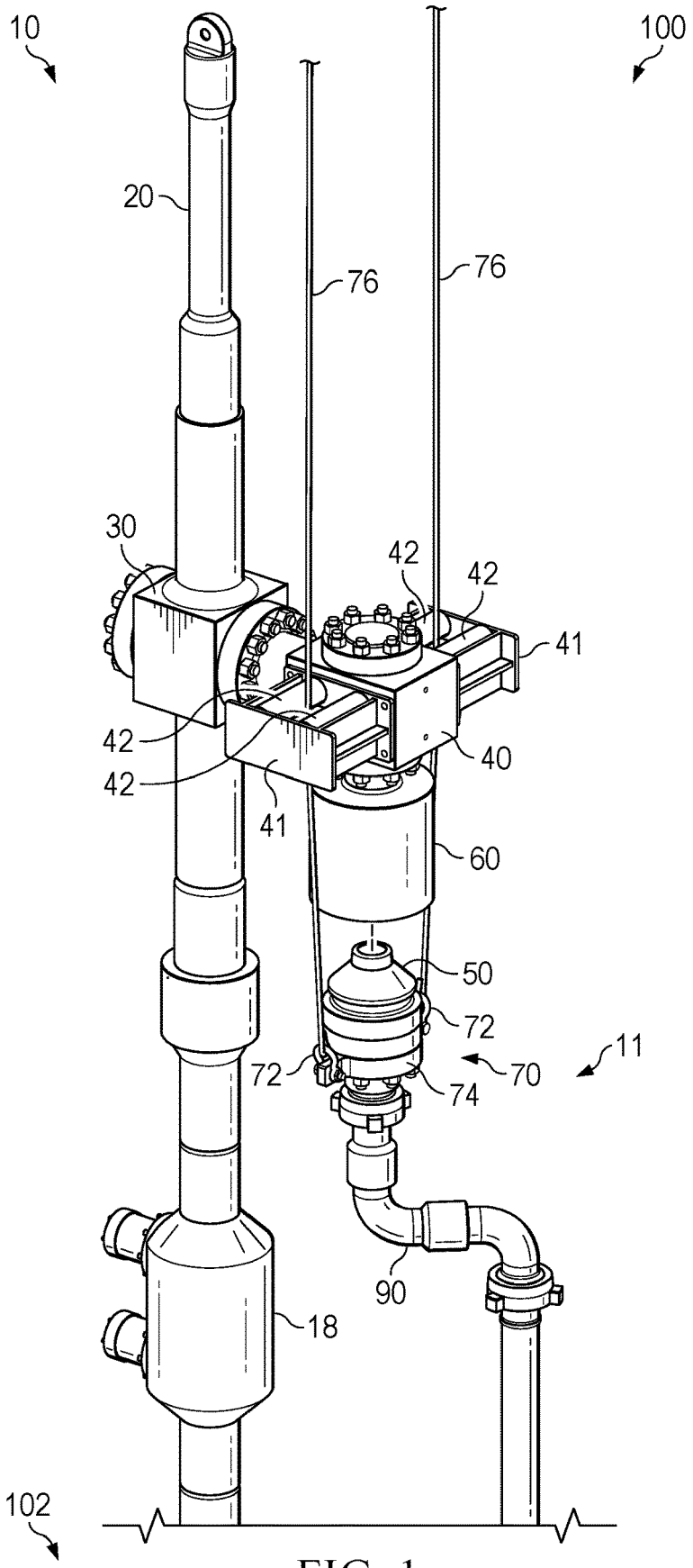
FIG. 1 depicts a perspective view of a hydraulic fracturing connecting line system.

FIG. 1 illustrates a perspective view of a hydraulic fracturing connecting line system 100. Referring to FIG. 1, the hydraulic fracturing connecting line system 100 provides hydraulic fracturing fluid to a wellbore 102. In the depicted example, the hydraulic fracturing system includes a hydraulic fracturing head 10 that directs fracturing fluid to the wellbore 102. In some embodiments, the hydraulic fracturing head 10 receives fluid flow from a side entry sub 30. During operation, the hydraulic fracturing head 10 directs fluid flow from the side entry sub 30 toward the wellbore 102. In some embodiments, flow to the wellbore is controlled by the dual valve 18.

Prior to fracturing operations, the hydraulic fracturing head 10 can be coupled to the wellbore 102. In some embodiments, the hydraulic fracturing head 10 will be elevated by a lift sub 20 over the wellbore 102 and connected to the wellbore 102. During installation, the lift sub 20 attaches to the work string of a rig. In some embodiments, the hydraulic fracturing head 10 is coupled to a "Christmas tree" assembly connected to the wellbore 102 to control fluid production from the well.

During operation, the hydraulic fracturing head 10 can facilitate connections with fluid sources. In the depicted example, the side entry sub 30 of the hydraulic fracturing head 10 can receive fluid flow from an external fluid source, such as a hydraulic fracturing fluid boat and provide the fluid flow to a downhole location. As illustrated, a hydraulic fracturing tubing line 11 can provide fluid connectivity between the external fluid source and the hydraulic fracturing head 10. In some embodiments, the hydraulic fracturing head 10 can include an adapter block 40 to facilitate removable connections between the hydraulic fracturing head 10 and the hydraulic fracturing tubing line 11. While "tubing" is used as an example in this embodiment, this is not meant to be limiting and can include other hoses, piping, fluid conduits, and other similar components.

Figure 2:
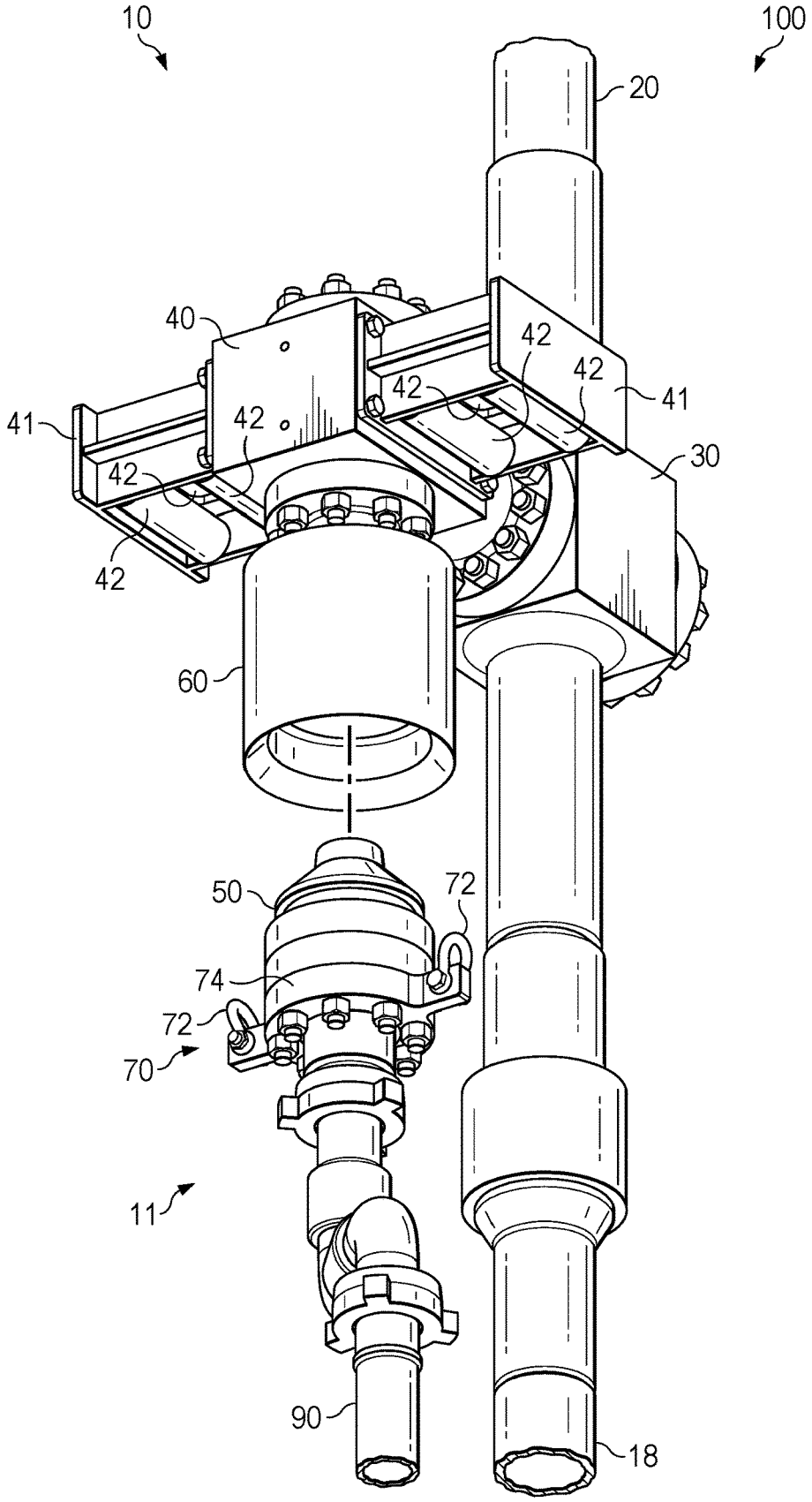
FIG. 2 depicts a detail view of the connectors of the hydraulic fracturing connecting line system of FIG. 1.

With reference to FIGS. 1 and 2, the hydraulic fracturing head 10 includes a latching receptacle 60 to facilitate a removable or releasable connection between the hydraulic fracturing head 10 and the hydraulic fracturing tubing line 11. As illustrated, the latching receptacle 60 is coupled to the adapter block 40 and allows for fluid to flow from the latching receptacle 60 to the hydraulic fracturing head 10 and the wellbore 102. In some embodiments, the adapter block 40 serves as the connecting bridge between latching receptacle 60 and side entry sub 30.

Similarly, the hydraulic fracturing tubing line 11 includes a stinger or male connector 50 configured to engage with latching receptacle 60 of the hydraulic fracturing head 10. As illustrated, the male connector 50 is an adapter configured to stab into latching receptacle 60. In the depicted example, the mating cavity of latching receptacle 60 is configured to receive the male connector 50. The male connector 50 is tapered in shape and configured to self-align or center within the latching receptacle 60. Similarly, the latching receptacle 60 can have a tapered or funnel design configured to align, center, or otherwise accept the tapered shape of the male connector 50.

Once the male connector 50 is seated within the latching receptacle 60, the connection between the components is engaged hydraulically. Advantageously, the hydraulic engagement between the male connector 50 and the latching receptacle 60 can be achieved remotely. During operation, hydraulic pressure provided by a hydraulic line opens latches on the latching receptacle 60 to accept the male connector 50 and establish the connection between the male connector 50 and the latching receptacle 60. Once the male connector 50 has been stabbed within the latching receptacle 60, the hydraulic pressure is released, closing the latches, and engaging the seal between male connector 50 and latching receptacle 60. Once the connection between the male connector 50 and the latching receptacle 60 is engaged, the hydraulic fracturing tubing line 11 and hydraulic fracturing head 10 are in fluid connectivity with each other.

Upon establishing fluid connectivity between the hydraulic fracturing head 10 and hydraulic fracturing tubing line 11, hydraulic fracturing fluid can flow from a fluid source, through the hydraulic fracturing tubing line 11, to the hydraulic fracturing head 10, finally, then, to the wellbore 102 for hydraulic fracturing treatment. In this embodiment, hydraulic fracturing fluid is contemplated as the fluid, however, this is not meant to be limiting. The fluid may contain solids in suspension, for example, hydraulic fracturing proppant particles, or other types of fluids used in treatments, such as a chemical treatment or other enhanced oil recovery techniques, for example, matrix acidizing treatments, steam assisted gravity drainage treatment, or others.

In certain applications, such as certain offshore applications, the hydraulic fracturing tubing line 11 is elevated to couple with the hydraulic fracturing head 10. Specifically, in certain applications, the male connector 50 is elevated to couple with the latching receptacle 60. While embodiments described in this application disclose a male connector 50 and a latching receptacle 60, other forms of connection may be used, including but not limited to, flanged couplings and mechanical couplings.

Further, while this embodiment discloses a remotely engaged hydraulic connection between the hydraulic fracturing head 10 and the hydraulic fracturing tubing line 11, other forms of connection are contemplated. For example, the remote connection could be made mechanically through a threaded connection, electronic engagement, or by pneumatic engagement. Not limited by the foregoing, the connection is engaged remotely, so as to avoid mechanical interaction by human personnel, for example, hammering a union joint.

During operation, the hydraulic fracturing tubing line 11 is moved or positioned relative to the hydraulic fracturing head 10 to facilitate a connection between the male connector 50 and the latching receptacle 60 and permit fluid flow therebetween. As depicted in FIG. 1, in some embodiments, the hydraulic fracturing tubing line 11 is elevated, positioned, or otherwise moved into engagement with the hydraulic fracturing head 10 using one or more connecting lines 76. In the depicted example, the connecting lines 76 can be cables, including but not limited to steel cables, synthetic cables, solid cables, braided cables, etc. The connecting lines can also include, but are not limited to, chains, cords, wires, and other similar forms.

In the depicted example, the connecting lines 76 are connected to the hydraulic fracturing tubing line 11 by attachment to a lifting saddle assembly 70. In some embodiments, the lifting saddle assembly 70 includes one or more hooks 72 to capture, receive, or otherwise facilitate attachment of the connecting lines 76 to the hydraulic fracturing tubing line 11. The hooks 72 can be closed hooks, open hooks, and may include a release functionality. In the depicted example, the hooks 72 are disposed on either side of a lifting saddle 74. In some embodiments, the lifting saddle assembly 70 can include any suitable number of hooks 72 in any suitable spacing and arrangement. As illustrated, the lifting saddle 74 couples to the male connector 50 in order to allow the connecting lines 76 to move or elevate the hydraulic fracturing tubing line 11. As illustrated, the lifting saddle 74 can be coupled to a lower portion of the male connector 50. In some embodiments, the lifting saddle 74 can couple to the male connector 50 via a bolted flange. Further, the lifting saddle 74 may be interposed between the male connector 50 and the tubing hose 90 of the hydraulic fracturing tubing line 11. Optionally, the lifting saddle 74 and/or other portions of the lifting saddle assembly 70 can be coupled to other suitable portions of the hydraulic fracturing tubing line 11.

Figure 3:
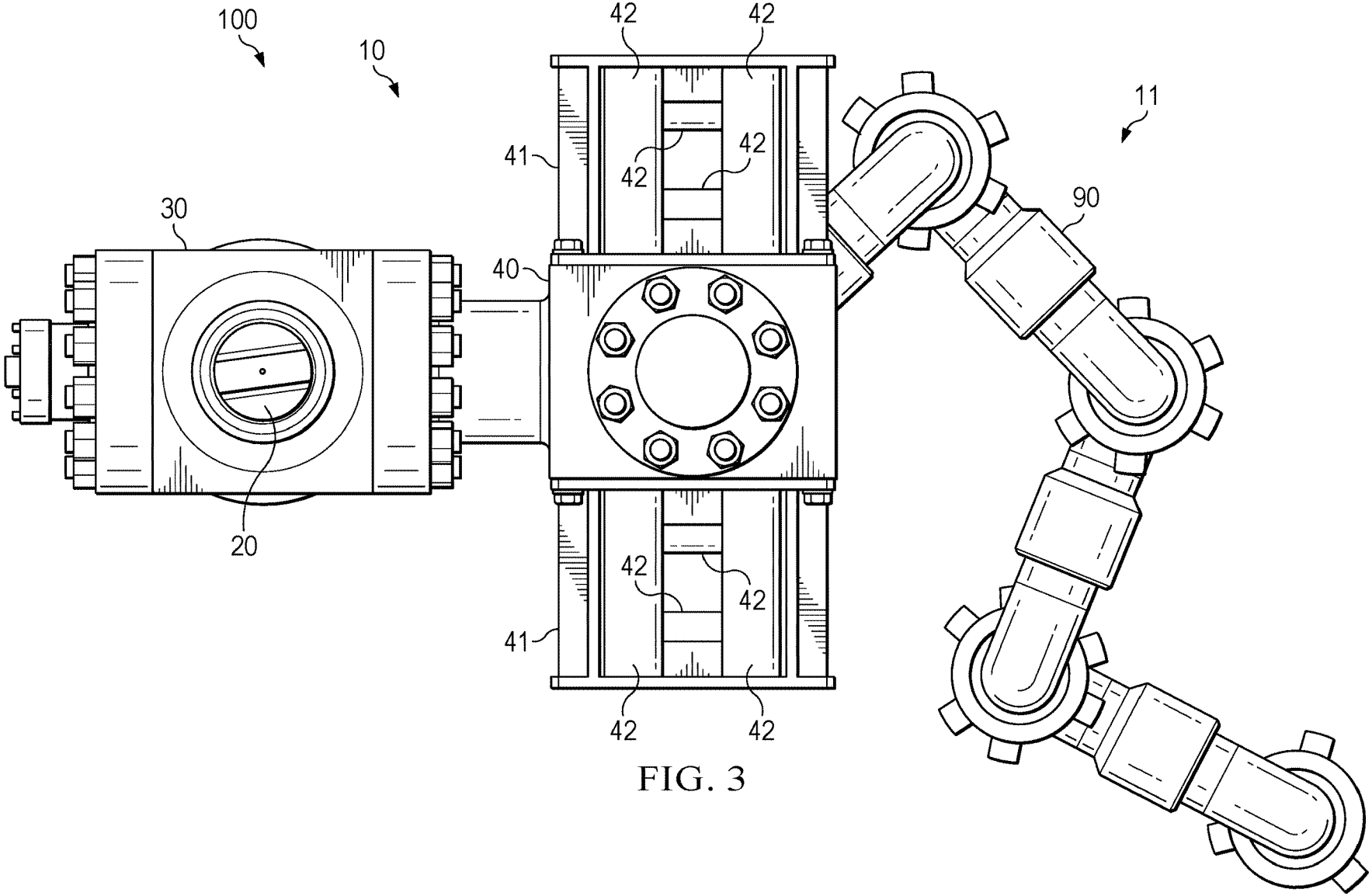
FIG. 3 depicts a top view of the embodiment of FIG. 1.

With reference to FIGS. 1-3, the dual roller assemblies 41 guide and facilitate movement of the connecting lines 76. As illustrated, the dual roller assemblies 41 are attached to an adapter block 40 of the hydraulic fracturing head 10. In the depicted example, the dual roller assemblies 41 are coupled to the adapter block 40 by bolts. However, it is contemplated that other forms of coupling or attachment may be used, for example, screws, anchors, rivets, and others.

In the depicted example, each dual roller assembly 41 includes rollers 42 to facilitate the movement of the connecting lines 76 relative to the hydraulic fracturing head 10. In some embodiments, each dual roller assembly 41 includes multiple rollers 42 to confine the lateral movement or drift of the connecting lines 76 relative to the hydraulic fracturing head 10 and other components. As illustrated, each of the dual roller assemblies 41 can contain four rollers 42. The four rollers 42 can be aligned in two sets, wherein each set has offsetting rollers 42 aligned parallel to each other. The other set of rollers 42 is aligned perpendicular to the first set of rollers 42 such that the rollers 42 provide a square profile or envelope. During operation, the lateral movement or drift of each connecting line 76 can be guided, confined, or limited by the arrangement or envelope defined by the rollers 42.

In accordance with some embodiments described herein, each set of rollers 42 can be perpendicularly offset so as to provide guidance to connecting lines 76 in each of the four directions. The orientations of the sets of rollers 42 is directionally agnostic. For example, with reference to FIG. 3, the rollers 42 aligned top to bottom of the figure plane can be rearranged to a left to right arrangement, so long as the second set of rollers 42 in each dual roller assembly 41 is offset to the orientation of the first set of rollers 42. While in some embodiments the sets of rollers 42 in each dual roller assembly 41 is perpendicularly aligned, this is not intended to be limiting. Other orientations may be used, for example, an offset of 45 degrees between the two sets.

In operation, the connecting lines 76 are guided by or drawn over the rollers 42 to move hydraulic fracturing tubing line 11 relative to hydraulic fracturing head 10. Advantageously, the rollers 42 serve at least two functions. First, the rollers 42 can guide the connecting lines 76 as they elevate hydraulic fracturing tubing line 11 to the hydraulic fracturing head 10. Second, the rollers 42 can reduce wear on the dual roller assembly 41 and the connecting lines 76 to prevent damage or failure of the components.

In some embodiments, other suitable devices can be used to move and/or guide the connecting lines 76. For example, in some embodiments, a dual winch system may be used in place of the dual roller assemblies 41 to move and/or guide the connecting lines 76. In some embodiments, the connecting lines 76 are drawn by the dual winch system to elevate or position the hydraulic fracturing tubing line 11 relative to the hydraulic fracturing head 10. Optionally, the winches can guide the connecting lines 76 with or without the use of rollers 42.

Figure 4:
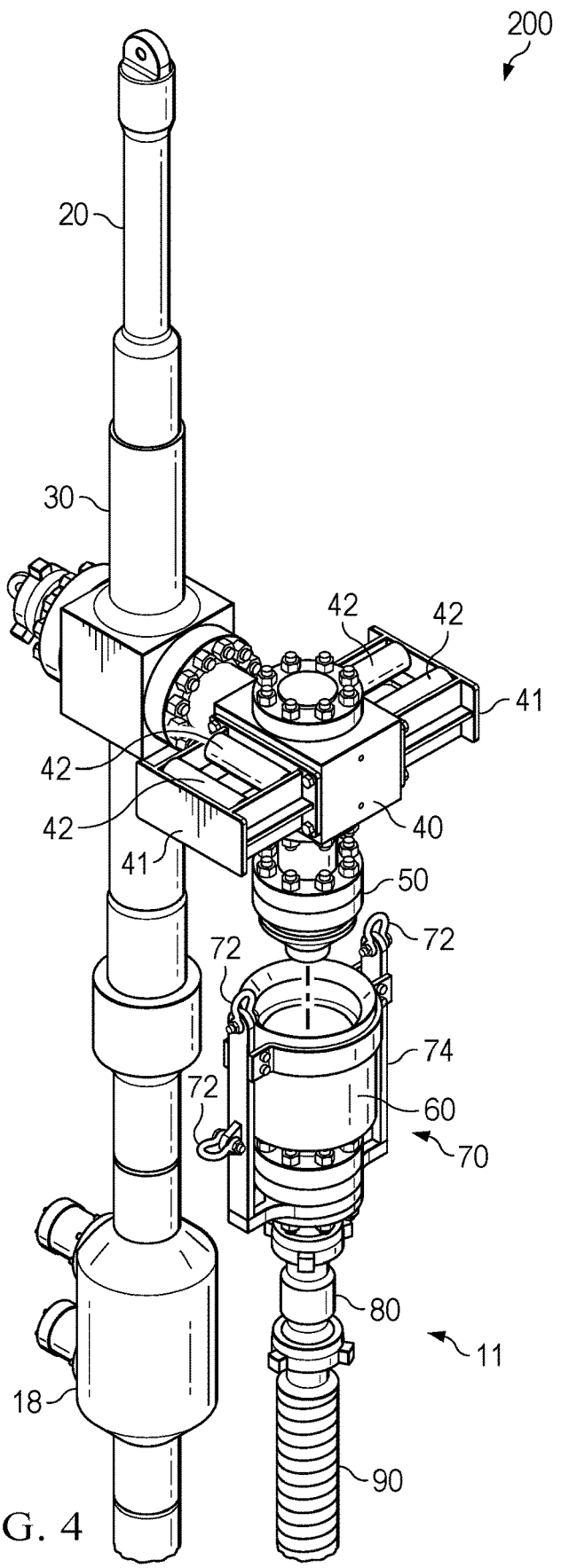
FIG. 4 depicts a perspective view of an embodiment of a hydraulic fracturing connecting line system.

Referring to FIG. 4, an embodiment of a hydraulic fracturing connecting line system 200 depicts an different configuration of the connection between the hydraulic fracturing head 10 and hydraulic fracturing tubing line 11. As illustrated, the orientation and/or arrangement of male connector 50 and latching receptacle 60 may be changed from the embodiment depicted in hydraulic fracturing connecting line system 100. In the depicted example, latching receptacle 60 is connected to hydraulic fracturing tubing line 11 and male connector 50 is connected to hydraulic fracturing head 10.

In some embodiments, the hydraulic fracturing connecting line system 200 includes a swivel 80 attached to the tubing hose 90 to prevent tangling of the tubing hose 90 in operation. The swivel 80 allows the tubing hose 90 to rotate axially around the axis of the connection formed between the male connector 50 and latching receptacle 60.

Thus, in accordance with some embodiments of the hydraulic fracturing connecting line system 200, the latching receptacle 60 can be guided over the top of male connector 50. Engagement of the connection between the latching receptacle 60 and the male connector 50 can be done in a similar manner as described with respect to hydraulic fracturing connecting line system 100. The connection is remotely hydraulically engaged.

Figure 5:
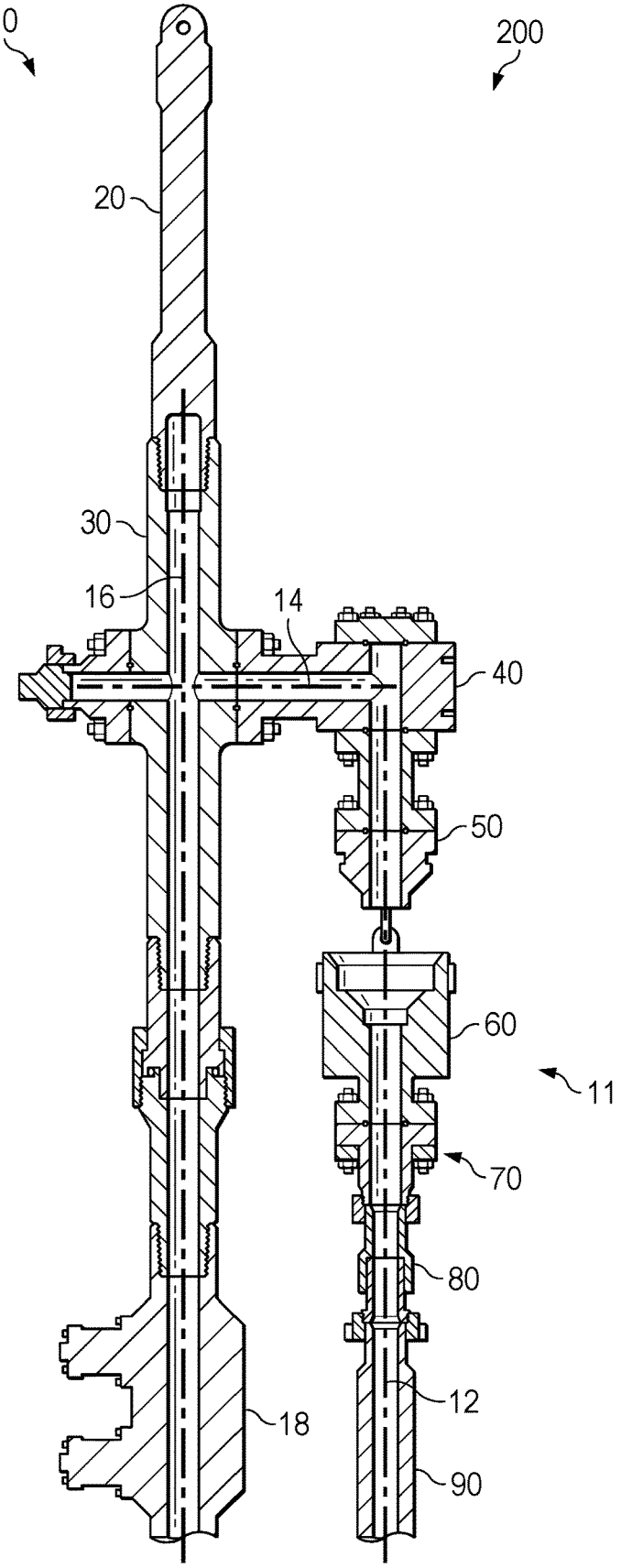
FIG. 5 depicts a cross-sectional view of the embodiment in FIG. 4.

Referring to FIG. 5, a depiction of the fluid flow path of hydraulic fracturing connecting line system 200 is shown. Fluid enters the hydraulic fracturing tubing line 11 into the hydraulic fracturing tubing inner diameter 12 from a fluid source, such as a hydraulic fracturing boat. That fluid passes through the connection between latching receptacle 60 to male connector 50 into the side entry sub inner diameter 14. Finally, the fluid travels to hydraulic fracturing head inner diameter 16 and into the wellbore 102 for treatment.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted.

Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A method for attaching a hydraulic fracturing tubing line to an elevated hydraulic fracturing head, the method comprising:

attaching a plurality of connecting lines to a lifting saddle coupled to the hydraulic fracturing tubing line;

via the connecting lines, vertically lifting a first connector of the hydraulic fracturing tubing line to engage with a second connector of the elevated hydraulic fracturing head; and remotely engaging the first connector and the second connector while the connecting line supports the hydraulic fracturing tubing line.

2. The method of claim 1, wherein the first connector of the hydraulic fracturing tubing line comprises a male connector.

3. The method of claim 1, wherein the first connector comprises a female connector.

4. The method of claim 1, further comprising attaching the elevated hydraulic fracturing head to a wellbore.

5. The method of claim 1, wherein the connecting line comprises a chain.

6. The method of claim 1, further comprising guiding the connecting line via an assembly of rollers coupled to the elevated hydraulic fracturing head.

7. A method for providing fluid to a wellbore, the method comprising:

via a plurality of connecting lines attached to a lifting saddle coupled to a hydraulic fracturing tubing line, vertically lifting a first connector of the hydraulic fracturing tubing line to engage with a second connector of an elevated hydraulic fracturing head in fluid connection with the wellbore;

remotely engaging the first connector of the hydraulic fracturing tubing line and the second connector of the elevated hydraulic fracturing head while the connecting line supports the hydraulic fracturing tubing line;

establishing a fluid connection between the hydraulic fracturing tubing line and the elevated hydraulic fracturing head; and providing fracturing fluid from a fluid source in fluid connectivity with the hydraulic fracturing tubing line to the wellbore.

8. The method of claim 7, wherein the first connector of the hydraulic fracturing tubing line comprises a male connection.

9. The method of claim 7, wherein the first connector of the hydraulic fracturing tubing line comprises a female connection.

10. The method of claim 7, further comprising guiding the connecting line via an assembly of rollers coupled to the elevated hydraulic fracturing head.

* * * * *